US006084942A

United States Patent [19]

Hell et al.

[11] Patent Number: 6,084,942

[45] Date of Patent: Jul. 4, 2000

[54] ROTATING BULB X-RAY RADIATOR WITH NON-PUMPED COOLANT CIRCULATION

[75] Inventors: Erich Hell, Erlangen; Thomas Ohrndorf, Altendorf; Peter Schardt, Roettenbach, all of Germany

[73] Assignee: Siemens Aktiengesellschaft, Munich, Germany

[21] Appl. No.: 09/157,637

[22] Filed: Sep. 21, 1998

[30] Foreign Application Priority Data

Sep. 22, 1997 [DE] Germany ..... 197 41 750

[51] Int. Cl.[7] ..... H01J 35/10

[52] U.S. Cl. ..... 378/200; 378/130; 378/141

[58] Field of Search ..... 375/119, 121, 375/125, 130, 131, 141, 144, 199, 200

[56] References Cited

U.S. PATENT DOCUMENTS

| | | | |
|---|---|---|---|
| 2,900,543 | 8/1959 | Heuse | 378/130 |
| 3,733,490 | 5/1973 | Roche | 378/130 |
| 4,734,927 | 3/1988 | Leguen et al. . | |
| 5,384,820 | 1/1995 | Burke | 378/135 |
| 5,703,926 | 12/1997 | Bischof | 378/200 |

FOREIGN PATENT DOCUMENTS

| | | |
|---|---|---|
| 881974 | 7/1953 | Germany . |
| 1015547 | 9/1957 | Germany . |

*Primary Examiner*—David P. Porta
*Attorney, Agent, or Firm*—Hill & Simpson

[57] ABSTRACT

An x-ray radiator has a rotating bulb tube whose vacuum housing rotates within the radiator housing filled with a fluid coolant, as well as with an external heat exchanger for the cooling of the coolant, with the coolant admission connector and the coolant discharge connector for the coolant conducted through the external heat exchanger without a circulating pump arranged at respective positions of the radiator housing at which a lower pressure and a higher pressure are generated by the rotation of the rotating bulb.

7 Claims, 1 Drawing Sheet

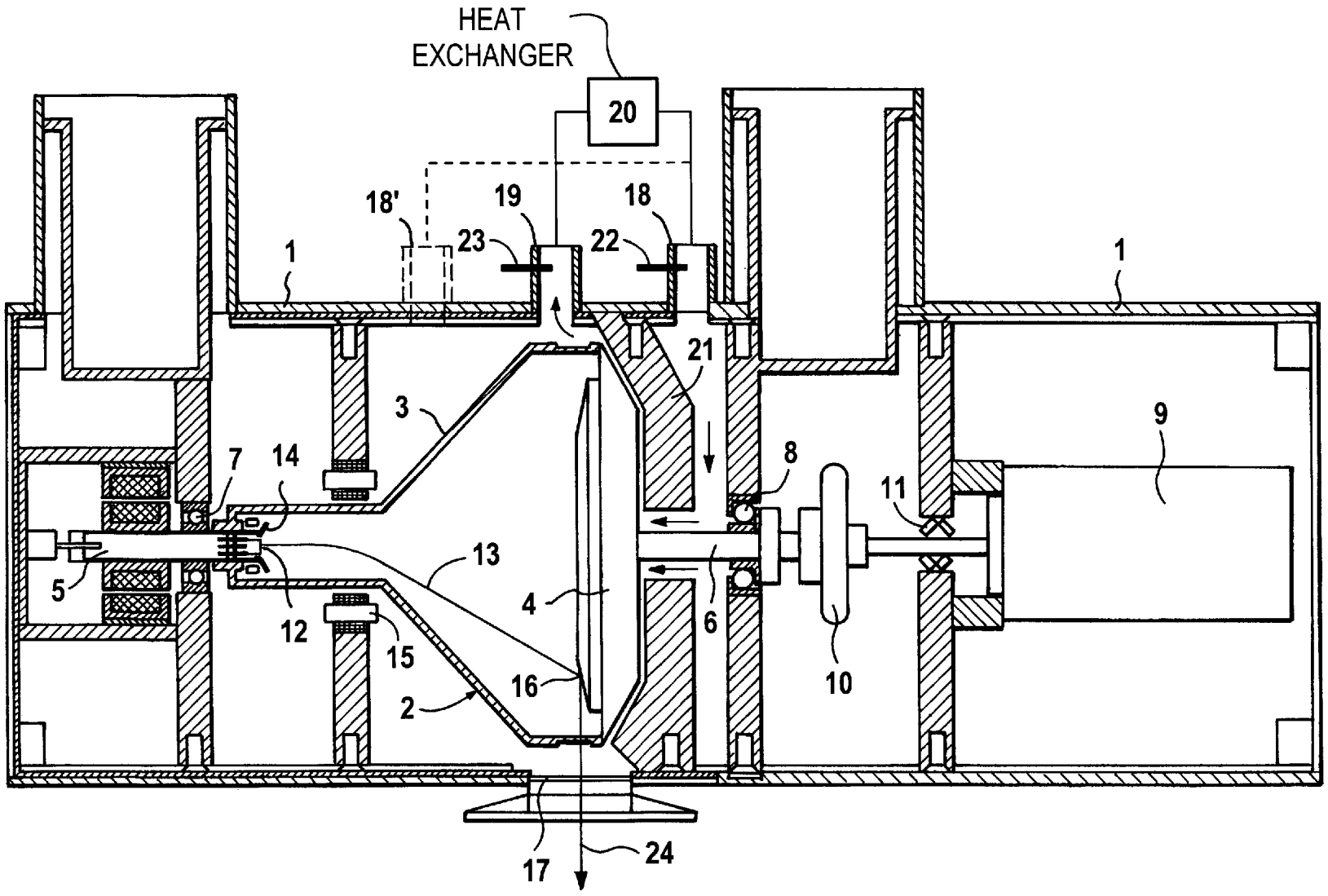
HEAT
EXCHANGER
20
1
9
11
10
8
6
21
18
22
19
23
18'
24
17
4
16
13
3
2
15
14
12
7
5

ROTATING BULB X-RAY RADIATOR WITH NON-PUMPED COOLANT CIRCULATION

BACKGROUND OF THE INVENTION

1. Field of the Invention

The present invention is directed to a x-ray radiator of the type containing a rotating bulb tube which rotates within a radiator housing filled with a fluid coolant, with a cooling system for the coolant including an external heat exchanger.

2. Description of the Prior Art

When the waste heat produced in the generation of x-rays in an x-ray radiator is not too great, natural convection can be exploited in order to transport the heat away from the tube. Given higher tube powers, however, the heat transfer coefficients that can be achieved are too low to rely on convention. Only higher flow rates of the coolant then provide alleviation, for which purpose circulating pumps have been conventionally utilized in the cooling system, which produce a correspondingly high coolant circulation.

The employment of such circulating pumps causes not only increased costs, but the susceptibility of such circulating pumps to failure represents a further cause that can lead to an outage of the x-radiator.

Avoidance of the use of such pumps is achieved in a rotating bulb tube disclosed in German Patent 881 974, by providing a ribbing on the rotating tube, or the rotating tube can be provided with propellers for conveying the coolant. These measures, however, lead to a complicated and expensive structure of the rotating tube.

SUMMARY OF THE INVENTION

An object of the present invention is to provide a radiator of the above general type wherein the use of a circulating pump is avoided but wherein it is still possible to convey the coolant through the heat exchanger with a simple structure of the rotating bulb.

This object is inventively achieved in an x-ray radiation having a housing containing a rotating bulb-type x-ray tube, the housing having a coolant admission connector and a coolant discharge connector for coolant conducted through an external heat exchanger without a circulating pump, these connectors being arranged at respective positions of the radiator housing at which a lower pressure and a higher pressure are produced by the rotation of the substantially smooth rotating bulb. Preferably the coolant discharge connector is arranged at a location in the region of the largest diameter of the rotating tube and the coolant admission connector is arranged in the region of a smaller diameter of the rotating tube.

The invention makes use of the fact that a non-uniform pressure distribution forms in the inside of the radiator housing without the presence of propellers, ribs and the like, due to the rotation of the rotating bulb, i.e. of the vacuum housing as well, among other things. The pressure difference as a consequence of this non-uniform pressure distribution usually suffices in order to convey the coolant through the heat exchanger without special measures. The pressure difference, however, can be adapted to respective requirements by the shaping the rotating bulb and dimensioning of the spacing between the rotating bulb and the radiator housing, these adjustments being within the capabilities of technicians in this field. It is thus possible to also achieve a pressure difference sufficiently large for a high throughput of the coolant. In the case of the invention, thus, the rotating bulb of the rotating bulb tube itself performs a pumping function without requiring special measures that complicate the structure of the rotating bulb and to make it more expensive than necessary. Pump capacities can be realized that are adequate in order to also be able to eliminate high levels of dissipated power from the rotating anode with correspondingly high flow rates of the coolant.

In an embodiment, a number of coolant admissions, preferably two coolant admissions arranged at opposite axial positions with respect to the coolant discharge, are provided, particularly in a region neighboring the shaft attached to the rotating bulb, i.e. in a region with a small diameter of the rotating bulb.

Since the available usable volume of the stream of coolant which is produced given the standard geometry of rotating bulb tubes—large diameter in the region of the rotating anode and small diameter in the region of the cathode—is extremely large, in a version of the invention adjustable diaphragms for controlling the coolant flow are arranged in the cooling system, particularly in the coolant admission and/or discharge connectors of the radiator housing. As passive components, such diaphragms can not represent a failure risk as do active control elements in conjunction with circulating pumps, so that the inventive cost-reduction of the structure of an x-ray radiator can be achieved while simultaneously increasing the overall dependability.

DESCRIPTION OF THE DRAWING

The single FIGURE is a side sectional view of an exemplary embodiment of an x-ray radiator constructed and operating in accordance with the principles of the present invention.

DESCRIPTION OF THE PREFERRED EMBODIMENTS

The FIGURE shows an x-ray radiator having a radiator housing 1 in which a rotating bulb tube referenced 2 overall is accepted. The rotating bulb tube 2 has a rotating bulb that is formed by the vacuum housing 3, the rotating anode 4 rigidly connected thereto, as well as shaft stubs 5 and 6 respectively attached to the vacuum housing 3 and to the rotating anode 4.

The rotating bulb is seated in two bearings 7, 8 so as to be rotatable around its center axis and can be placed in rotation with an electric motor 9 via a coupling 10.

The entire interior of the radiator housing 1, except for the space accepting the electric motor 9 and sealed by a suitable seal 11, is filled with a fluid coolant, preferably electrically insulating oil.

A cathode 12 that serves for generating an electron beam 13, that is focused with a Wehnelt electrode 14 is arranged in the vacuum housing 3.

The electron beam 13 is deflected by an electromagnetic deflection system 15 so that it strikes the rotating anode 4, rotating together with the rotating bulb, in a stationary point, namely the focal spot 16. X-ray radiation then emanates from the focal spot 16, only the central ray 24 being shown in the FIGURE. The x-ray radiation emerges from the rotating bulb tube 2 through the vacuum housing 3, which has a reduced wall thickness in this region, and exits the radiator housing 1 through a beam exit window 17.

As is known, during operation of the x-ray radiator the cathode 12 is supplied with a filament voltage, the Wehnelt electrode 14 is supplied with a focusing voltage, the deflection system 15 is supplied with a deflection voltage and the rotating bulb tube 2 is supplied with a tube voltage adjacent between the cathode and the rotating anode 4 in a way that is not shown in greater detail in the FIGURE. The tube voltage is sufficiently high so that x-rays are produced when the electrons of the electron beam 13 strike the rotating anode 4.

The bearings 7, 8, the seal 11 and the deflection system 15 are accepted in partitions of the radiator housing 1.

The radiator housing 1 has a coolant admission connector 18 and a coolant discharge connector 19. The coolant discharge connector 19 is arranged in a region of large diameter, namely in the region of the largest diameter, of the rotating bulb. By contrast thereto, the coolant admission connector 18 is arranged in a region neighboring the shaft stub 6 as seen in the axial direction of the arrangement, i.e. in a region of small diameter.

As a result of the rotation of the rotating bulb in the fluid coolant, accordingly, a lower pressure is present in the region of the coolant admission connector 18 than in the region of the coolant discharge connector 19. The coolant is thus conveyed by the rotation of the bulb through a heat exchanger 20 (only schematically indicated in the FIGURE) that is connected via schematically indicated lines to the coolant admission connector 18 and the coolant discharge connector 19.

Since the coolant conducted into the radiator housing 1 through the coolant admission connector 18 flows past the rotating anode 4 on its path to the coolant discharge connector 19, convention cooling of the rotating anode 4 occurs. This is further improved by a baffle 21 inserted into the radiator housing 1 between the coolant admission connector 18 and the coolant discharge connector 19. The side of the baffle 21 facing toward the rotating anode 4 is adapted in shape to the rotating anode 4 and limits a relatively narrow gap through which the coolant is conveyed. It is thus clear that, in the invention, the coolant is conveyed through the heat exchanger 20 solely by the specific nature of the positioning of the coolant admission connector 18 and the coolant discharge connector 19. This is achieved even though the rotating bulb is constructed substantially rotational-symmetrically and is smooth at its outside surface, i.e. without riflings, ribs or the like that have been used in earlier devices for conveying the coolant.

As a result, the utilization of a circulating pump for the coolant is superfluous. Not only are the costs for the circulating pump thereby eliminated but also an additional cause of failure that a wear-affected circulating pump always represents is eliminated. Moreover, the rotating bulb is constructed simply and economically as a consequence of its smooth fashioning.

As can be seen from the FIGURE, diaphragms in the form of slides 22 and 23 are provided respectively in the regions of the coolant admission connector 18 and the coolant discharge connector 19, these diaphragms making it possible to modify the flow cross sections in the region of the coolant admission connector 18 and the coolant discharge connector 19. Thus it is possible to set the respectively desired volume stream of the coolant through the heat exchanger 20 independently of the speed of the rotating bulb.

As also shown in the FIGURE in a broken-line illustration, there is the possibility of providing a second coolant admission connector 18' that, as viewed in the axial direction with respect to the coolant discharge connector 19, assumes a position opposite the coolant admission connector 18 and, like the coolant admission connector 18, lies in a region wherein the rotating bulb exhibits a smaller diameter than in the region of the coolant discharge connector 19, so that the coolant also exhibits a lower pressure here.

The optimum conveying effect for the coolant is achieved when the coolant admission connector 18 is located in the region of the pressure minimum in the coolant and when the coolant discharge connector 19 is located in the region of the pressure maximum of the coolant.

Although modifications and changes may be suggested by those skilled in the art, it is the intention of the inventors to embody within the patent warranted hereon all changes and modifications as reasonably and properly come within the scope of their contribution to the art.

We claim as our invention:

1. An x-ray radiator comprising:

a radiator housing filled with a fluid coolant;

a rotating bulb x-ray tube disposed in said fluid coolant in said housing and mounted for rotation in said fluid coolant in said housing, said rotating bulb x-ray tube having a substantially smooth exterior and, upon rotation, producing a higher pressure region and a lower pressure region in said coolant in said radiator housing;

a coolant admission port disposed in said housing at one of said lower pressure region or said higher pressure region, and a coolant discharge port disposed in said radiator housing at the other of said lower pressure region or said higher pressure region; and a heat exchanger disposed outside of said radiator housing and connected in a fluid path between said coolant admission port and said coolant discharge port, said coolant being conducted through said heat exchanger solely by a coolant flow caused by said higher pressure region and said lower pressure region produced by rotation of said rotating bulb x-ray tube.

2. An x-ray radiator as claimed in claim 1 wherein said rotating bulb x-ray tube has a region of largest diameter, and a region of smaller diameter, and wherein said coolant discharge port is disposed in said housing adjacent said region of largest diameter and wherein said coolant admission port is disposed in said radiator housing adjacent said region of smaller diameter.

3. An x-ray radiator as claimed in claim 2 wherein said coolant admission port comprises a first coolant admission port, and wherein said x-ray radiator further comprises a second coolant admission port, said first and second coolant admission ports being disposed at opposite axial positions relative to said coolant discharge port.

4. An x-ray radiator as claimed in claim 1 further comprising at least one adjustable diaphragm disposed in said fluid path for regulating coolant flow in said fluid path.

5. An x-ray radiator as claimed in claim 4 wherein said at least one adjustable diaphragm is disposed at said coolant admission port.

6. An x-ray radiator as claimed in claim 4 wherein said at least one adjustable diaphragm is disposed at said coolant discharge port.

7. An x-ray radiator as claimed in claim 1 comprising an adjustable diaphragm disposed at said coolant admission port and an adjustable diaphragm disposed at said coolant discharge port.

* * * * *